US008888524B2

(12) United States Patent
Martin et al.

(10) Patent No.: US 8,888,524 B2
(45) Date of Patent: Nov. 18, 2014

(54) MODULAR POWER ADAPTER ASSEMBLY

(71) Applicant: Hewlett-Packard Development Company, L.P., Houston, TX (US)

(72) Inventors: Randall W. Martin, The Woodlands, TX (US); Fred Charles Thomas, III, Fort Collins, CO (US); Andrew Leonard Zee, Causeway Bay (HK); Matthew Graeme Leck, London (GB); Jonathan Patrick Summers, Causeway Bay (HK); Marcus Andrew Hoggarth, London (GB); Morten Villiers Warren, London (GB)

(73) Assignee: Hewlett-Packard Development Company, L.P., Houston, TX (US)

( * ) Notice: Subject to any disclaimer, the term of this patent is extended or adjusted under 35 U.S.C. 154(b) by 139 days.

(21) Appl. No.: 13/630,434

(22) Filed: Sep. 28, 2012

(65) Prior Publication Data

US 2014/0094065 A1 Apr. 3, 2014

(51) Int. Cl.
*H01R 11/00* (2006.01)

(52) U.S. Cl.
USPC ..... 439/502; 439/638

(58) Field of Classification Search
USPC ..... 439/105, 501, 502, 638, 651
See application file for complete search history.

(56) References Cited

U.S. PATENT DOCUMENTS

| | | | | |
|---|---|---|---|---|
| 5,409,397 | A * | 4/1995 | Karman | 439/484 |
| 5,720,628 | A * | 2/1998 | Usui et al. | 439/502 |
| 6,337,444 | B1 * | 1/2002 | Liao | 174/135 |
| 6,428,348 | B1 | 8/2002 | Bean | |
| 6,433,274 | B1 * | 8/2002 | Doss et al. | 174/50 |
| 6,567,277 | B1 | 5/2003 | Doherty et al. | |
| 7,040,931 | B1 * | 5/2006 | Achtner et al. | 439/651 |
| 7,422,452 | B2 * | 9/2008 | Achtner et al. | 439/106 |
| 7,467,971 | B2 * | 12/2008 | Lin et al. | 439/501 |
| 7,585,182 | B2 * | 9/2009 | Asante et al. | 439/502 |
| 7,887,341 | B2 * | 2/2011 | Liao | 439/131 |
| 8,133,072 | B2 * | 3/2012 | Huang et al. | 439/502 |
| 8,552,339 | B2 * | 10/2013 | Yunk et al. | 219/130.1 |

OTHER PUBLICATIONS

Apple Portables: Troubleshooting MagSafe Adapters; Mar. 12, 2012; 2 pages.
Cable Management; "Bits & Pieces"; http://www.kimiushida.com/bitsandpieces/ramblings/cable_management/index.html; Mar. 23, 2009; 4 pages.
Golson, Jordan; "Energizer introduces New Wrap-around Iphone Chargers"; May 3, 2012; 3 pages.
Julie; "Kensington Portable Power Outlet Review"; The Gadgeteer; Aug. 21, 2008; 9 pages.

* cited by examiner

*Primary Examiner* — Thanh Tam Le

(57) ABSTRACT

Embodiments of the present invention disclose a modular power adapter assembly for a portable electronic device. According to one example embodiment, the assembly includes a power adapter housing and an extender member connected to the adapter housing at a first end region thereof. Furthermore, a plug adapter is configured to receive power and removably attach to a second end region of the extender member. A cable is attached to the adapter housing to supply power to a connected portable electronic device.

15 Claims, 5 Drawing Sheets

MODULAR POWER ADAPTER ASSEMBLY

BACKGROUND

The emergence and popularity of mobile computing has made portable electronic devices—due to their compact design and light weight—a staple in today's marketplace. As these devices become further miniaturized, maintaining satisfactory battery power and life becomes a greater concern. The batteries of mobile devices, such as notebook computers, are generally powered via connection of a power adapter and cord with an electrical power outlet. Typical power adapters provide alternating current (AC) voltage through AC cords and/or cables of varying length. And when traveling abroad with the portable electronic device, in addition to managing overlong cords or wires for the power adapter, the user must also carry a bulky "duck-head" style interface adapter that connects to the body of the power adapter and is localized for various regional-specific electrical plug configurations.

BRIEF DESCRIPTION OF THE DRAWINGS

The features and advantages of the inventions as well as additional features and advantages thereof will be more clearly understood hereinafter as a result of a detailed description of particular embodiments of the invention when taken in conjunction with the following drawings in which.

DETAILED DESCRIPTION OF THE INVENTION

Figure 1A:
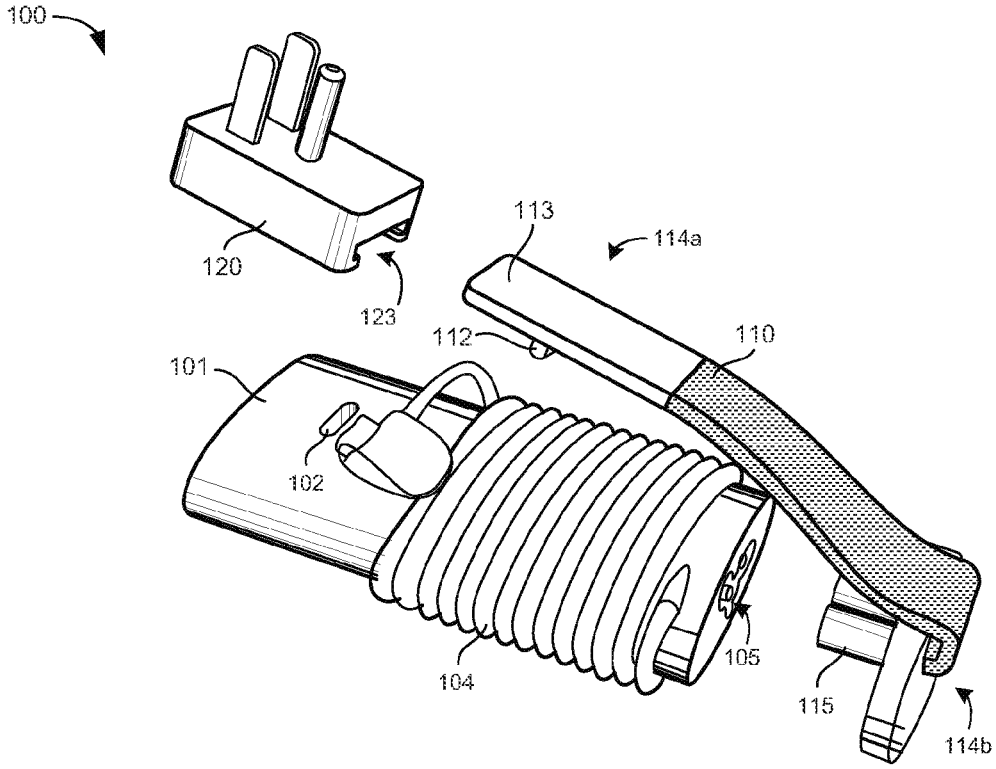
FIGS. 1A and 1B are three-dimensional perspective views of the modular power adapter assembly according to an example of the present invention.

The following discussion is directed to various embodiments. Although one or more of these embodiments may be discussed in detail, the embodiments disclosed should not be interpreted, or otherwise used, as limiting the scope of the disclosure, including the claims. In addition, one skilled in the art will understand that the following description has broad application, and the discussion of any embodiment is meant only to be an example of that embodiment, and not intended to intimate that the scope of the disclosure, including the claims, is limited to that embodiment. Furthermore, as used herein, the designators "A", "B" and "N" particularly with respect to the reference numerals in the drawings, indicate that a number of the particular feature so designated can be included with examples of the present disclosure. The designators can represent the same or different numbers of the particular features.

The figures herein follow a numbering convention in which the first digit or digits correspond to the drawing figure number and the remaining digits identify an element or component in the drawing. Similar elements or components between different figures may be identified by the user of similar digits, For example, 143 may reference element "43" in FIG. 1, and a similar element may be referenced as 243 in FIG. 2. Elements shown in the various figures herein can be added, exchanged, and/or eliminated so as to provide a number of additional examples of the present disclosure. In addition, the proportion and the relative scale of the elements provided in the figures are intended to illustrate the examples of the present disclosure, and should not be taken in a limiting sense.

Prior solutions to the aforementioned problems include a hook and loop fastener(s) attached to the direct current (DC) cord and/or AC cord for cable management of the power adapter assembly. However, even when using the hook and loop fastener, the power cord undesirably hangs away from the adapter housing and thus fans to provide a simple and clean management solution. In order to ensure that the adapter assembly can fit into tight locations such as conference room tables or power strips, the user typically must carry a lengthy AC cord, usually over four feet in length, along with a country-specific AC plug interface adapter for international travel.

Embodiments of the present invention disclose a modular power adapter for a portable electronic device. According to one example, the power adapter includes a "pig-tail" style AC cable extender. That is, the present configuration disclosed herein provides additional utility through a modular extender cable/strap that plugs into the body of the AC adapter in place of the traditional AC cord. For example, the extension cable portion allows for plug connection in constricted outlet locations when undocked, while also providing a cable management feature for the DC cord when the extender portion is docked with the power adapter housing.

Figure 1B:
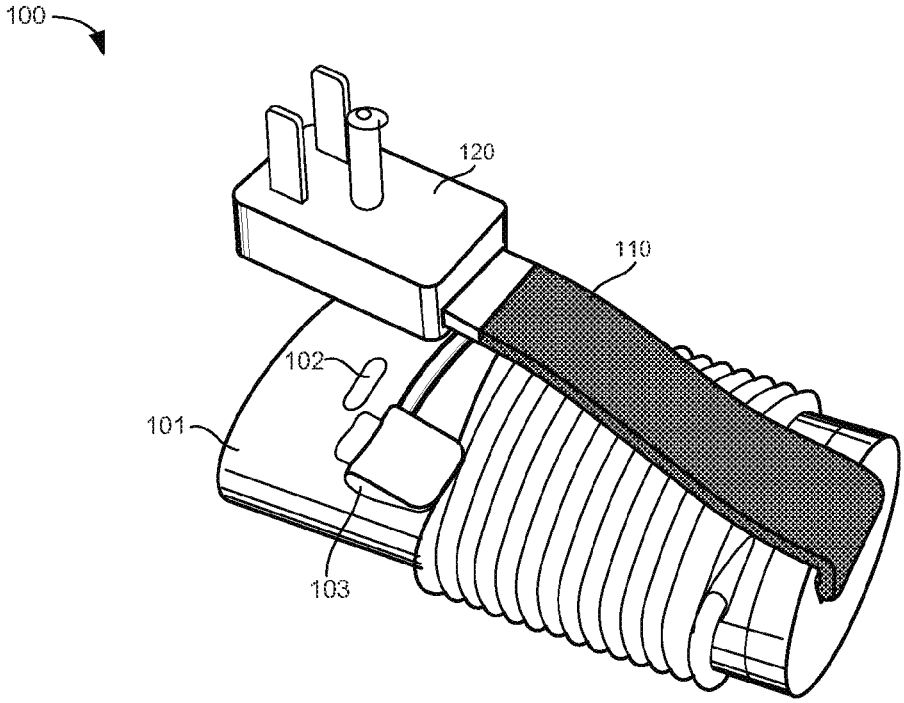

Referring now in more detail to the drawings in which like numerals identify corresponding parts throughout the views, FIGS. 1A and 1B are three-dimensional perspective views of the modular power adapter assembly according to an example of the present invention. As shown in FIG. 1A, the power adapter assembly 100 comprises a power adapter body or housing 101, an extender member 110, and a plug adapter connector 120. The housing 101 includes an integrated power cord 104 (e.g., DC power cord) for connection with a portable electronic device (e.g., notebook computer) via power connector 103. The adapter housing 101 further includes a retainer port 102 and an AC interface port 105 for receiving a compatible AC plug. According to the present examples, a user can plug in a traditional AC power cord or the shortened or "pig-tail" style extender cable 110 disclosed herein into the interface port 105 of the adapter housing 101. The extender cable 110 includes a docking tab 112 and connector head portion 113 formed on an upper end 114*a*, and a power plug connector 115 formed on a lower end 114*b* thereof. Specifically, the upper or first end region 114*a* comprises a region where the power extender cable 110 connects to the docking tab 112, while the lower or second end region 114*b* comprises a region opposite the first end region 114*a* of the power extender cable 110 where the power extender cable 110 connects to the AC interface port 105. The docking tab 112 is configured to mate with the retainer port 102 of the adapter housing 101. Furthermore, plug adapter 120 includes an aperture 123 for receiving the connector head 113 of the extender member 110. More particularly, the extender cable 110 includes the requisite electrical wiring for enabling the connector head 113 to provide a modular electrical interface for an attached plug adapter 120 via AC power provided through connection of plug portion 115 with power interface 105 of the adapter housing 101 as shown in FIG. 1B.

Figure 2B:
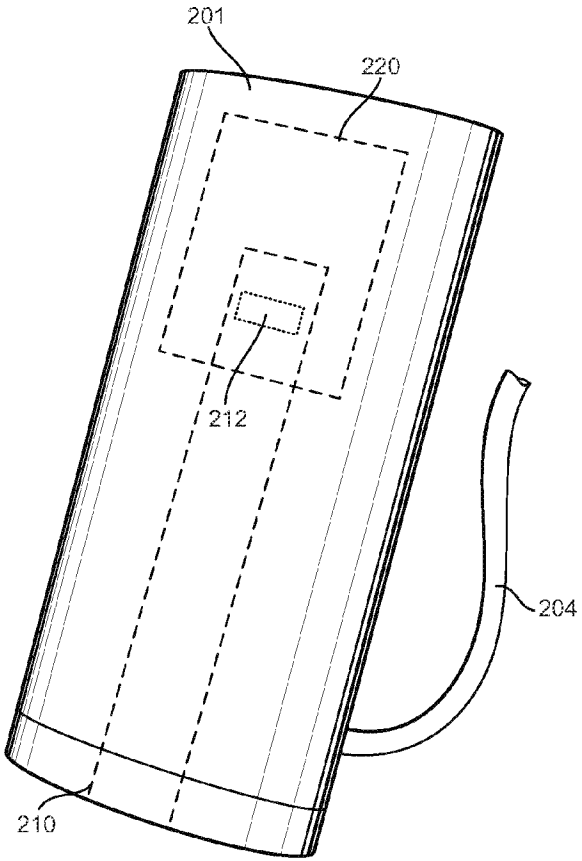
FIGS. 2A and 2B are three-dimensional perspective views of a front side and rear side respectively of the modular power adapter assembly according to an example of the present invention.
Figure 2A:
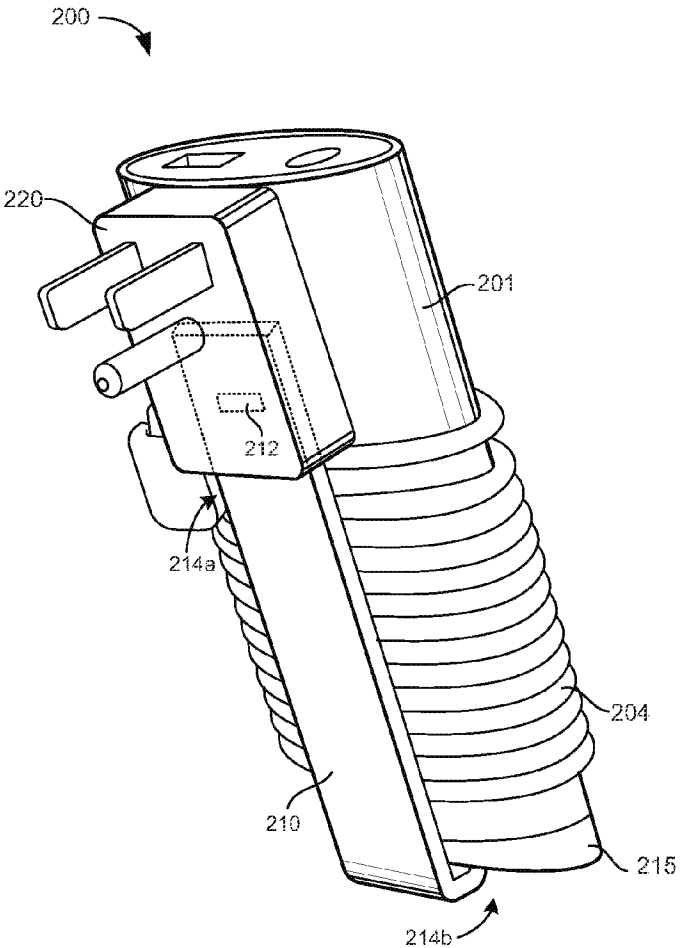

FIGS. 2A and 2B are three-dimensional perspective views of a front side and rear side respectively of the modular power adapter assembly according to an example of the present invention. FIG. 2A depicts the power adapter assembly 200 in a "docked" position in which the extender cable 210 is attached to the housing body 201 at both a tab connecting_region 214*a* (via docking tab 212) and a plug interface region 214*b* (via plug portion 215). As shown here, when in this docked position, the extender cable 210 serves as a cable management feature by retaining the power cord 204 in a fixed position against a facing surface of the housing body 201 after wrapping the power cord 204 around the adapter body 201. FIG. 2B depicts a rear side of the modular power adapter assembly 200 in accordance with one example embodiment. Here, power cable 204 is unwrapped with respect to the housing 201, while the docking tab 212 and plug adapter 220 are adjacent to the main body of the power adapter 201.

Figure 3C:
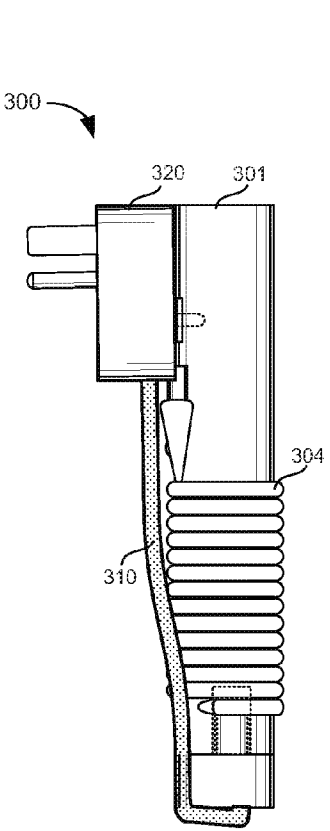
FIGS. 3A-3C are side profile views of the modular power adapter assembly according to an example of the present invention.
Figure 3B:
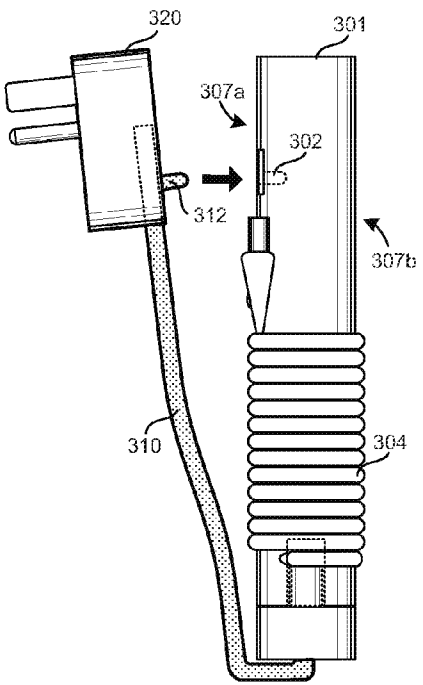
Figure 3A:
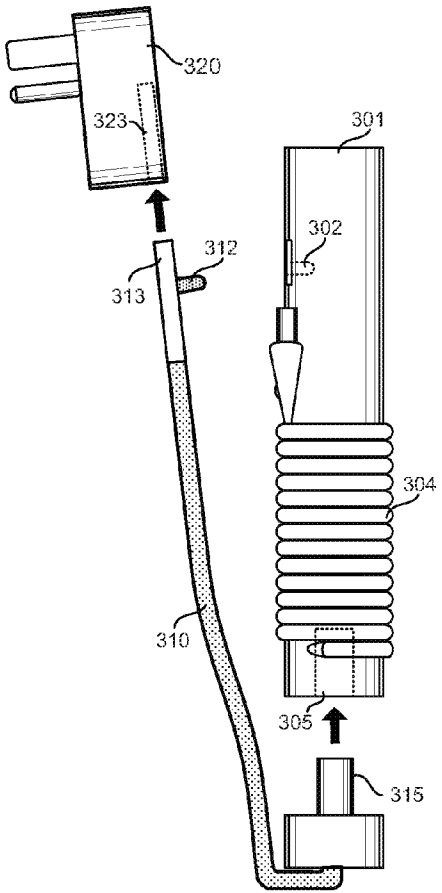

FIGS. 3A-3C are side profile views of the modular power adapter assembly according to an example of the present invention. As shown in FIG. 3A, the modular power adapter assembly 300 is unassembled such that three components: power adapter 301 and integrated power cord 304, extender member 310, and plug adapter 320 are detached from each other. Here, the power cord 304 is wrapped around the power adapter housing 301, which includes retainer port 302 and power interface port 305. The shortened extension cable or strap 310 includes: on a lower end region, a plug portion 315 for interfacing with power interface port 305; and on an upper end region opposite the lower end region, a docking tab 312 and connector head 313. The plug adapter connector 320 includes a receiving channel 323 for enabling removable attachment of the extension cable 310 with the plug adapter connector 320. Specifically, the plug adapter connector 320 is able to slide onto the connector head 313 and remain securely attached via channel 323 (e.g., friction fit), while simultaneously enabling easy detachment of the plug adapter 320 and channel 323 from the connector head 313 through force from a user.

Turning now to FIG. 3B, the connector head 313 of the extension strap 310 is attached to the plug adapter 320 (via channel 323), while the plug portion 315 of the extension strap 310 is inserted and coupled to the power interface port 305 of the adapter housing 301. The flexibility of extension strap 310 allows for bending such that the attached plug adapter 320 may be repositioned to contact an adjacent facing surface 307*a* (opposite rear surface 307*b*) of the adapter housing 310. As shown in FIG. 3C, when the modular power adapter assembly 300 is in a docked position, the plug adapter 320 may be positioned immediately adjacent to the facing surface 307*a* of adapter housing 301 such that the docking tab 312 of the extension cable 310 is inserted and joined with the retainer port 302 of the adapter housing 301. Still further, the power extension strap 310 now abuts the power cord 304 wrapped around the adapter housing 301 so as to provide cable management support for the adapter assembly 300. According to one example, the length of the extension strap 310 is substantially equal to the height/length of the power adapter housing 301 so that the extension strap 310 may effectively secure the power cord 304 against the adapter housing 301 when in the docked position shown in FIG. 3C.

Figure 4A:
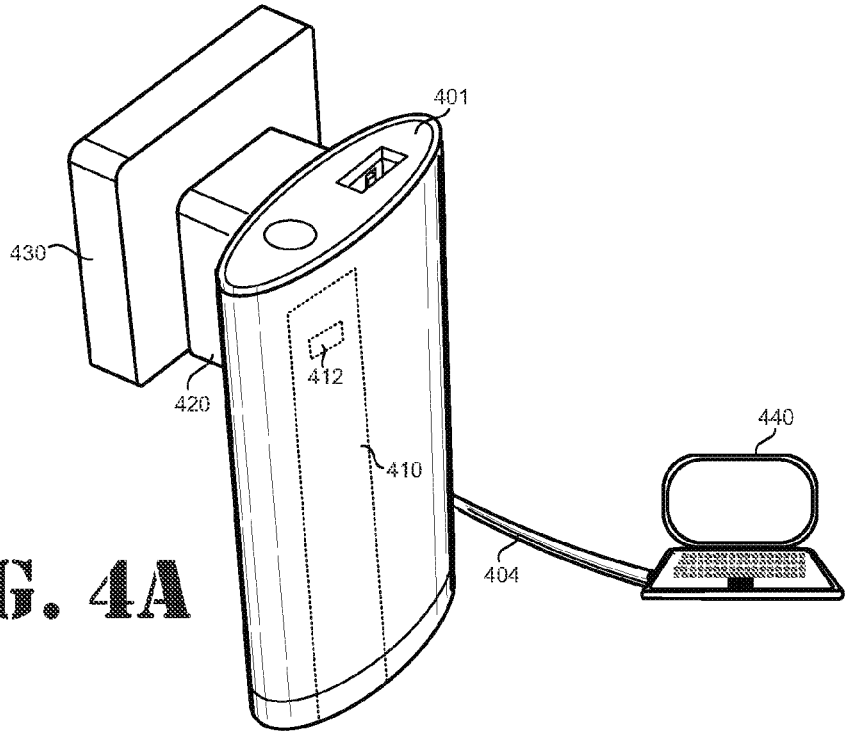
FIGS. 4A and 4B are illustrations of the modular power adapter assembly in multiple operating environments according to an example of the present invention.
Figure 4B:
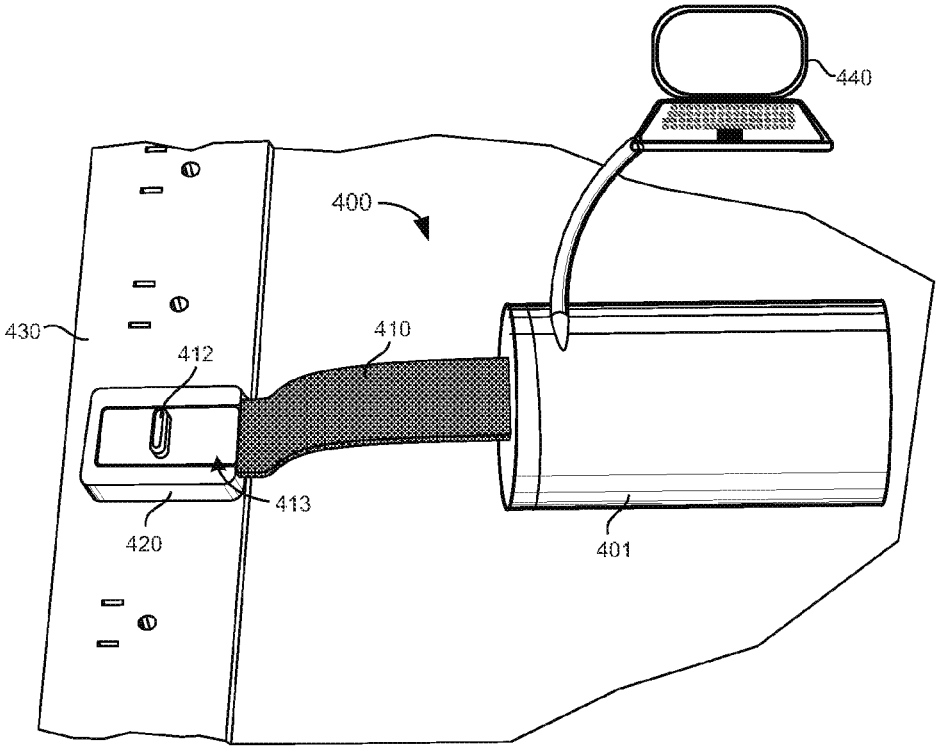

FIGS. 4A and 4B are illustrations of the modular power adapter assembly within multiple operating environments according to an example of the present invention. FIG. 4A depicts the power adapter assembly inserted into a wall-mounted power socket 430. As shown, a user may attach the extender member 410 to the adapter housing 401 via the docking tab 412 as explained above. As a result, examples of the present invention provide a compact wall-mounted solution for providing power to a connected portable electronic device (e.g., notebook computer 440). Referring now to FIG. 4B, the power adapter assembly 400 is attached to a power strip having multiple power sockets/outlets. Instead of the larger adapter housing 401 blocking access to other power sockets, the power adapter assembly 400 of the present example is versatile in that the extender member 410 may be detached from adapter housing 401 and extend therefrom so as to allow the plug adapter 420 to plug into a power socket 430 without occlusion from the adapter housing 401. As shown here, the docking tab 412 of the extender member 410 is exposed on the backside of the plug adapter 420 and channel region 423 when in the undocked position. Moreover, the shortened length of the extender member 410 still allows for a clean and compact solution even when extender member 410 is in an extended position away from adapter housing 401 as shown in FIG. 4B.

Figure 5:
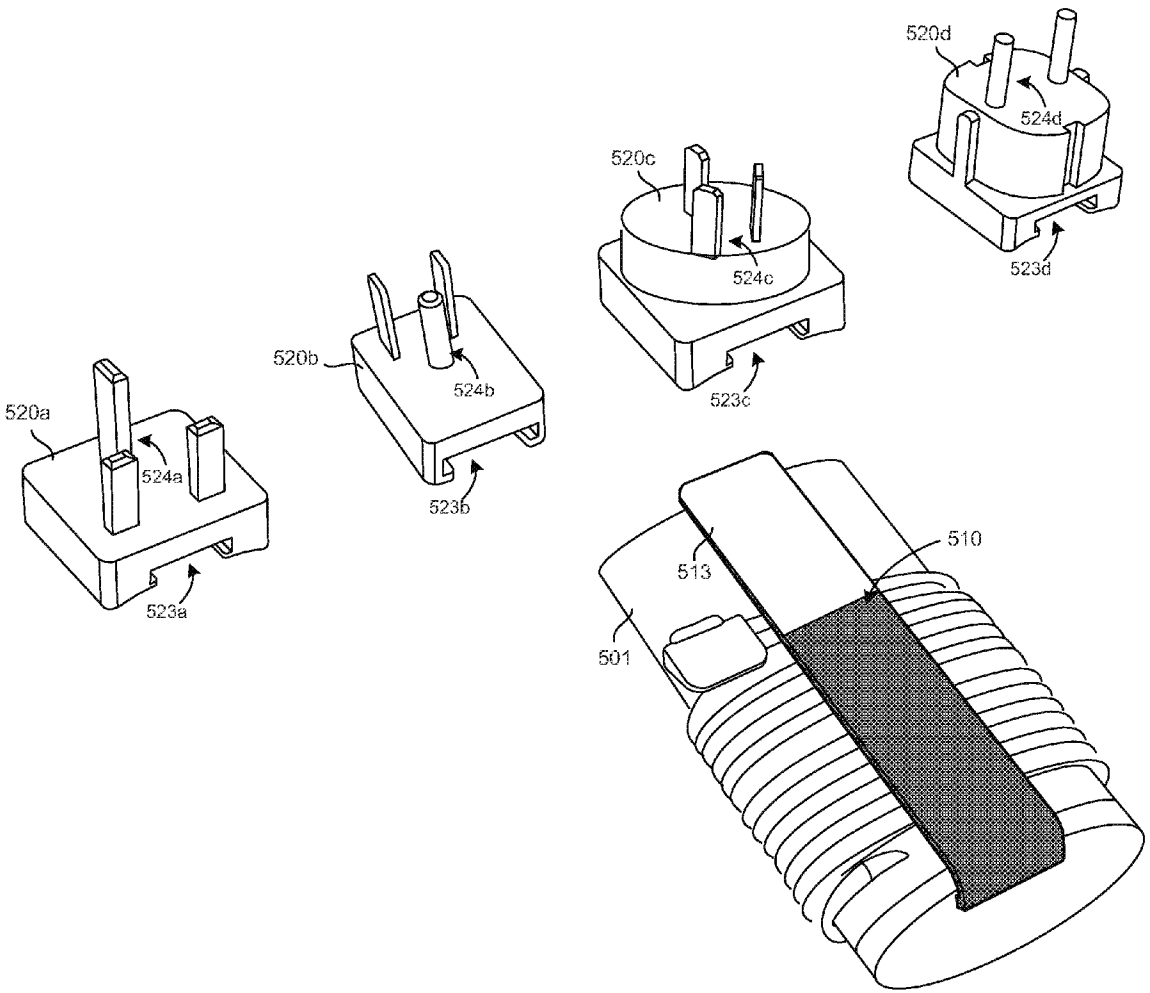
FIG. 5 is a three dimensional view of the modular power adapter and various plug adapter connectors according to an example of the present invention.

FIG. 5 is a three dimensional view of the modular power adapter and various plug adapter connectors according to an example of the present invention. The modular power adapter assembly is configured to provide universal connectivity by accommodating multiple region-specific plug adapters. For example, power adapter assembly may utilize a United Kingdom plug adapter 520*a*, United States plug adapter 520*b*, New Zealand plug adapter 520*c*, or European Union plug adapter 520*d*. However, these are but a few examples, as the power adapter assembly of the present embodiments may accommodate any compatible region-specific plug connector. More particularly, each plug adapter 520*a*-520*d* includes a receiving channel 523*a*-523*d* formed on an opposite side of electrical contacts 524*a*-524*d*, which plug into a region-based electrical power socket. As explained in detail above, the receiving channel 523*a*-523*d* of each plug adapter 520*a*-520*d* is configured to form a secure attachment fit with the connector head 513 of the power extender member 510.

In summary, embodiments of the present invention provide a modular power adapter assembly for a portable electronic device. Moreover, many advantages are afforded by the assembly in accordance with examples of the present invention. For instance, the extension strap of the adapter assembly helps to provide an integrated cable management system and a modular device for accommodating various region-specific plug interfaces. Moreover, the adapter assembly is versatile in that users can choose to carry the longer and bulker AC cord for connection with adapter housing. Still further, the short length of cable extender provides the flexibility of being able to fit the AC adapter plug into tight residential or commercial AC plug locations, thus allowing users to travel with a lighter and more compact solution without compromising usability.

Furthermore, while the invention has been described with respect to exemplary embodiments, one skilled in the art will recognize that numerous modifications are possible. For example, although exemplary embodiments depict an adapter housing of a particular size and a shape, the invention is not limited thereto. For example, the adapter body may be formed in a circular or square shape, or any other size and shape conducive to inclusion of the extender member and modular configuration described herein. Thus, although the invention has been described with respect to exemplary embodiments, it will be appreciated that the invention is intended to cover all modifications and equivalents within the scope of the following claims.

What is claimed is:

1. A modular power adapter assembly comprising:

a power adapter housing;

an extender member connected to the adapter housing at a first end region of the extender member;

a plug adapter to receive power on a second end region opposite of the first end region of the extender member, wherein the plug adapter removably attaches to the second end region of the extender member; and a cable attached to the adapter housing to supply power to an electronic device, wherein the power adapter housing includes a retainer port, and wherein the extender member includes a docking tab formed on the second end region to dock to the retainer port with the plug adapter is attached to the second end region.

2. The adapter of claim 1, wherein the extender member includes a plug portion on the first end region for connecting to a power interface port on the adapter housing.

3. The adapter of claim 2, wherein the extender member includes a connector head portion on the second end region.

4. The adapter of claim 3, wherein the plug adapter includes a channel for receiving the connector head portion of the extender member, and wherein the extender member and connector head portion provide an electrical interface for a plurality of region-specific plug adapters through coupling via the channel of the plug adapter.

5. The adapter of claim 3, wherein when the power cable is wrapped around the adapter housing, the extender member is to maintain the power cable in a fixed position against a surface of the adapter housing upon the docking tab being docked to the retainer port on the adapter housing.

6. The adapter of claim 1, wherein the cable is a DC power cord.

7. The adapter of claim 1, wherein the extender member is substantially the same length as the power adapter.

8. A modular power adapter and cable management system for powering an electronic device, the system comprising:

a power adapter having an attached power cord to connect and supply power to the electronic device;

a flexible strap to connect to the adapter housing at a lower region; and at least one plug connector removably attached to an upper region of the flexible strap and to receive power from the adapter housing, wherein the power adapter includes a retainer port, and wherein the upper end of the flexible strap includes a docking tab to dock to the retainer port with the plug connector is attached to the upper region.

9. The system of claim 8, wherein the flexible strap includes a plug portion on the first end region for connecting to a power port on the power adapter.

10. The system of claim 9, wherein the upper end of the flexible strap includes a connecting head.

11. The system of claim 10, wherein the plug connector includes a channel for receiving the connecting head of the flexible strap, and wherein the flexible strap and connecting head provide an electrical interface for a plurality of region-specific plug connectors.

12. The system of claim 10, wherein when the power cord is wrapped around the power adapter, the flexible strap is to maintain the power cable in a fixed position against a surface of the power adapter upon the tab portion being docked to the retainer port on the power adapter.

13. The system of claim 1, wherein the power cord supplies DC power to the portable electronic device.

14. The system of claim 1, wherein the flexible strap is substantially the same length as the power adapter.

15. A modular power adapter assembly comprising:

a power adapter and housing including a power interface port and an attached power cord to supply power to an electronic device;

an extension cable including a plug portion formed on a first end region for connecting to the power interface port of the adapter housing, wherein the extension cable includes a connecting head portion and docking tab formed on a second end region opposite the first end region; and a plug adapter to removably attach to the second end region of the extension cable to receive power from the power adapter, wherein the plug adapter includes a channel for receiving the connector head portion of the extension cable, wherein the extension cable and connector head portion provide an electrical interface for a plurality of region-specific plug adapters, wherein when the power cord is wrapped around the power adapter housing, the extension cable is to maintain the power cord in a fixed position against a facing surface of the adapter housing upon the tab portion being inserted into a retainer port formed on the facing surface of the power adapter housing, wherein extension cable is substantially the same length as the power adapter housing.

* * * * *